United States Patent [19]

Thurston et al.

[11] 4,224,983

[45] Sep. 30, 1980

[54] HEAT EXCHANGE APPARATUS FOR A REACTOR

[75] Inventors: Glenn C. Thurston; John D. McDaniels, Jr., both of Solana Beach; Paul R. Gertsch, San Diego, all of Calif.

[73] Assignee: General Atomic Company, San Diego, Calif.

[21] Appl. No.: 874,382

[22] Filed: Feb. 2, 1978

[51] Int. Cl.[2] ..... F28F 9/02; F28F 13/00

[52] U.S. Cl. ..... 165/158; 165/162; 122/32; 176/60

[58] Field of Search ..... 165/142, 158, 162; 176/38, 39, 60, 65, 87

[56] References Cited

U.S. PATENT DOCUMENTS

| | | | |
|---|---|---|---|
| 3,286,767 | 11/1966 | Evans | 165/162 |
| 3,325,374 | 6/1967 | Margen | 176/65 X |
| 3,868,994 | 3/1975 | Petrek | 165/142 |
| 3,923,007 | 12/1975 | Schrader | 122/32 |
| 4,013,121 | 3/1977 | Berger | 165/162 |
| 4,078,899 | 3/1978 | Keller et al. | 165/142 X |
| 4,098,329 | 7/1978 | Culver | 165/158 X |

*Primary Examiner*—Samuel Scott
*Assistant Examiner*—Theophil W. Streule, Jr.
*Attorney, Agent, or Firm*—Fitch, Even, Tabin, Flannery & Welsh

[57] ABSTRACT

A heat exchange apparatus for transferring heat from a reactor gas coolant to a secondary fluid medium. The heat exchange apparatus comprises an elongated vertically extending hole in a concrete shield. Supported within the hole in spaced relation to the wall thereof is an elongated vertical extending tubular shroud which shroud has a gas entry at its lower end and a gas exit at its upper end. Means are provided for dividing the annular space between the shroud 16 and the wall of the hole into an upper and a lower region. Disposed in the shield is an inlet for reactor coolant which communicates with the lower region and is positioned vertically so as to be spaced above the gas entry to the shroud to thereby suppress natural convection during non-operating standby conditions of the apparatus. An outlet for reactor coolant, which is disposed in the shield, communicates with the upper region. A plurality of vertically extending, spaced apart bayonet tube assemblies are supported within the shroud and means are provided for passing secondary fluid through these tube assemblies. A circulator is provided for causing the reactor coolant to flow in through the inlet, downward in the annular space, into the shroud through the gas entry, upward through the shroud and out through the outlet during emergency conditions of the reactor.

7 Claims, 15 Drawing Figures

35
47
46
12.
12.
48
37
26
39
13.
13.
51
43

37a
46a
47a
26a
35a
53
55
52

47
35
37
46
48
46
50

39
35
46
37
47

HEAT EXCHANGE APPARATUS FOR A REACTOR

The present invention relates to a heat exchanger and more particularly to a heat exchange apparatus for transferring heat from a reactor coolant to a secondary medium.

In order to remove heat from a gas cooled core of a nuclear reactor during standby and emergency conditions a heat exchange apparatus is provided. During emergency conditions, the coolant is circulated through the heat exchange apparatus which transfers the heat from the reactor coolant to a secondary medium. Such heat exchange apparatus should be constructed with a minimum of welds exposed to the reactor coolant and also so that parasitic heat loss during normal operation of the reactor is minimized. Also, the welds and heat transfer tubes in the heat exchange apparatus should be easily inspectable.

An object of the present invention is the provision of a heat exchange apparatus for transferring heat from a reactor coolant to a secondary medium. Another object is the provision of a heat exchange apparatus for use with a reactor gas coolant which includes one or more of the above-described desired features.

Other objects and advantages of the present invention will become apparent by reference to the following description and accompanying drawings wherein.

Figure 1:
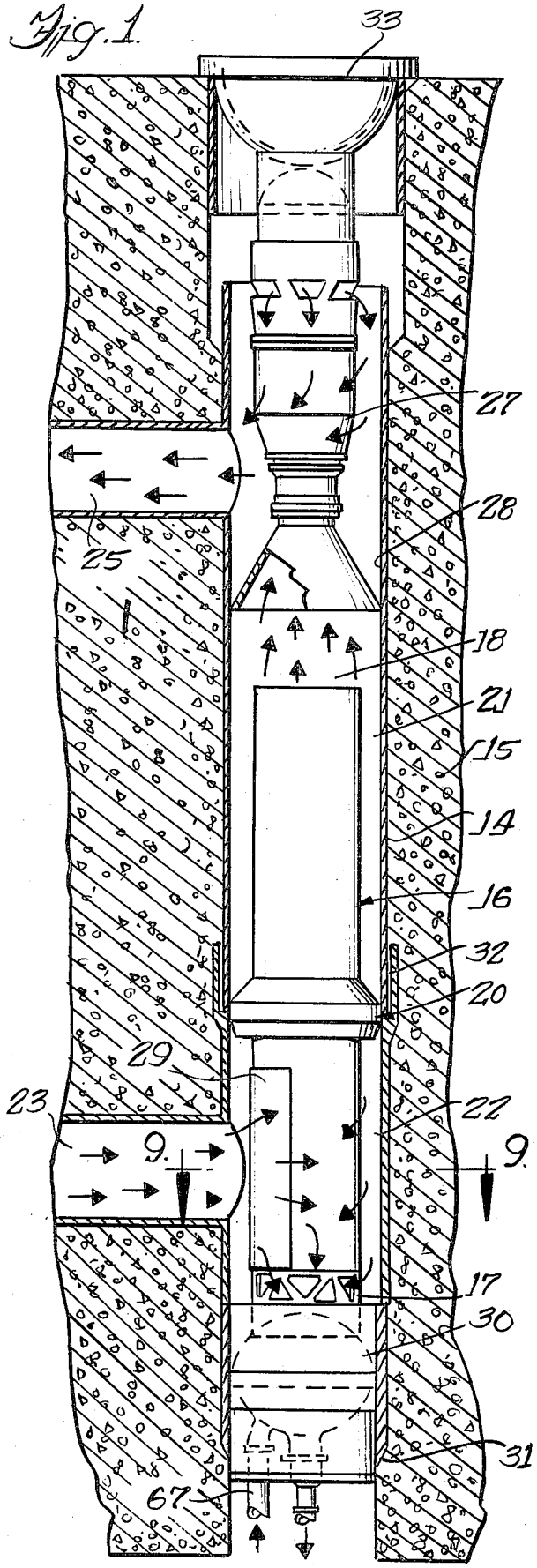
FIG. 1 is a vertical cross-sectional view of a heat exchange apparatus constructed in accordance with the present invention.

Generally, in accordance with the present invention, a heat exchange apparatus is provided for transferring heat from a reactor gas coolant to a secondary fluid medium. As shown in the drawings and in particular FIG. 1, the heat exchange apparatus comprises an elongated vertically extending hole 14 in a concrete shield 15. Supported within the hole 14 in spaced relation to the wall thereof is an elongated vertical extending tubular shroud 16 which has a gas entry 17 at its lower end and a gas exit 18 at its upper end. Means 20 are provided for dividing the annular space between the shroud 16 and the wall of the hole 14 into an upper 21 and a lower 22 region. Disposed in the shield 15 is an inlet 23 for reactor coolant which communicates with the lower region 22 and is positioned vertically so as to be spaced above the gas entry 17 to the shroud 16 to thereby suppress natural convection during non-operating standby conditions of the apparatus. An outlet 25 for reactor coolant, which is disposed in the shield 15, communicates with the upper region 21. A plurality of vertically extending, spaced apart bayonet tube assemblies 26 (FIG. 2) are supported within the shroud 16 and means are provided for passing secondary fluid through these tube assemblies 26. A circulator 27 is provided for causing the reactor coolant to flow in through the inlet 23, downward in the annular space 21, into the shroud 16 through the gas entry 17, upward through the shroud 16, out of the shroud at the exit 18, into the circulator 27 and out through the outlet 25 during emergency conditions of the reactor. More particularly, as shown in FIG. 1, the heat exchange apparatus is disposed within the elongated vertically extending, generally cylindrical hole 14 in the concrete shield 15. The hole 14 is lined with a thermal barrier 28 which may be an envelope of insulation. The inlet 23 for the reactor coolant, which may be helium, is provided by a lined horizontal duct disposed in the shield above the bottom of the hole 14. The outlet 25 for the reactor coolant is provided by a lined horizontal duct disposed in the shield near the top of the hole 14.

Figure 3:
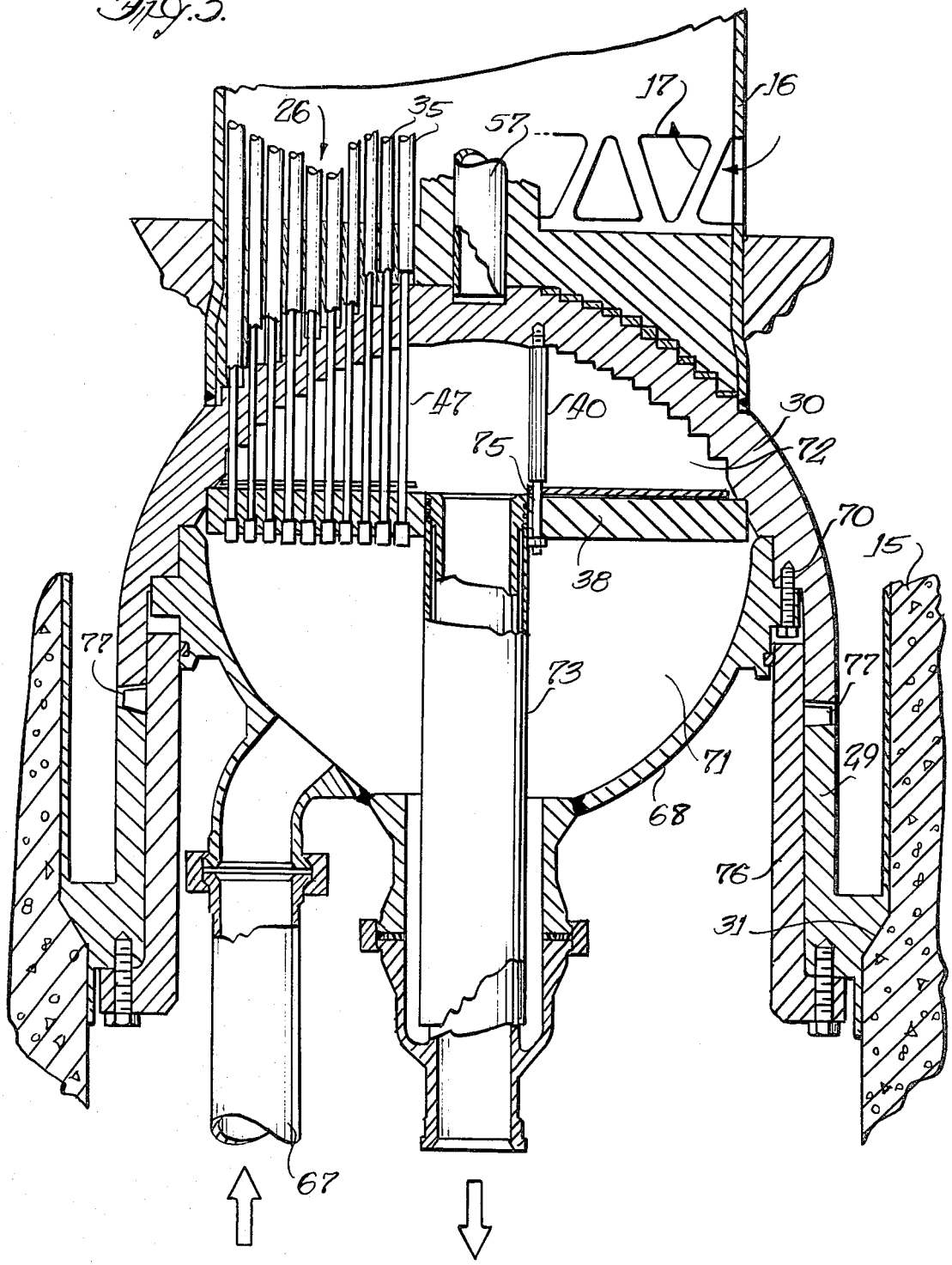
FIG. 3 is an enlarged vertical cross-sectional view of the lower portion of the heat exchange apparatus of FIG. 1.
Figure 4:
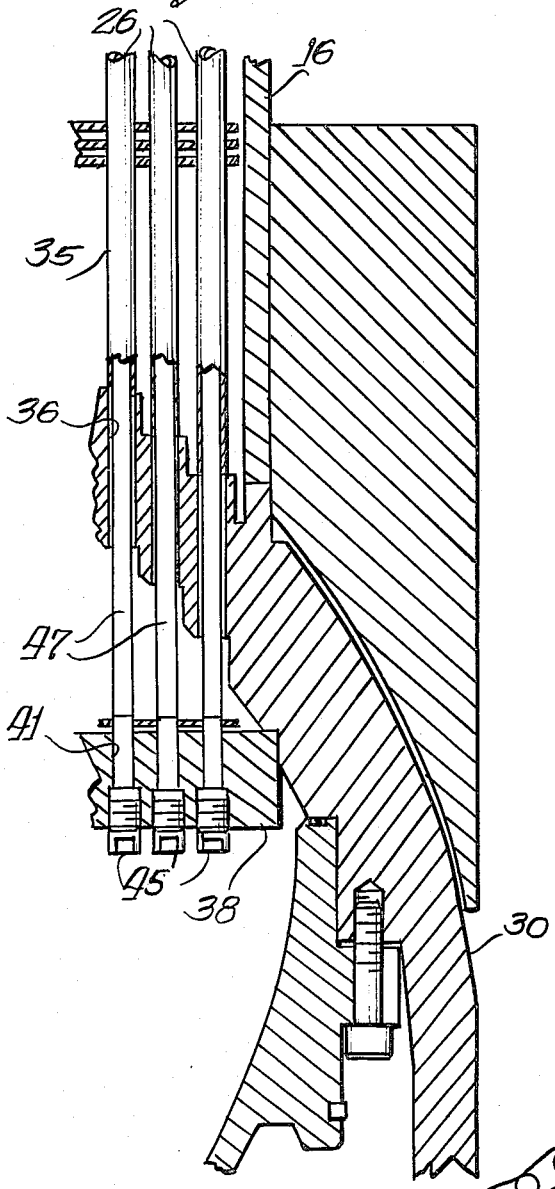
FIG. 4 is an enlarged vertical cross-sectional view taken generally along line 4—4 of FIG. 2.

The shroud 16, which is an elongated tubular sheet of suitable metal, is supported within the hole 14 in concentric relation thereto and spaced from the walls thereof. The shroud 16 extends below the reactor coolant inlet 23 and is supported in its vertical position by an upwardly facing generally hemispherical, upper tube sheet 30 which is supported within the hole 14. As shown in FIGS. 3 and 4, the upper tube sheet 30 is welded to an annular support 29 which is supported by a ledge 31 in the hole 14. This arrangement provides a continuous boundary for the primary coolant with respect to the atmosphere with only one weld. The upper tube sheet is fixed and differential expansion of the remaining parts of the heat exchange are absorbed by sliding joints.

The shroud 16 is supported laterally by the bell-shaped support 20 attached to the shroud 16 approximately midway between its ends. The bell-shaped support 20 bears against suitable seismic restraints 32 disposed in the envelope 28 between two sections thereof. The bell-shaped support 20 also serves to divide the annular space 21 between the shroud 16 and the envelope 28 into the upper 21 and the lower 22 regions.

Figure 9:
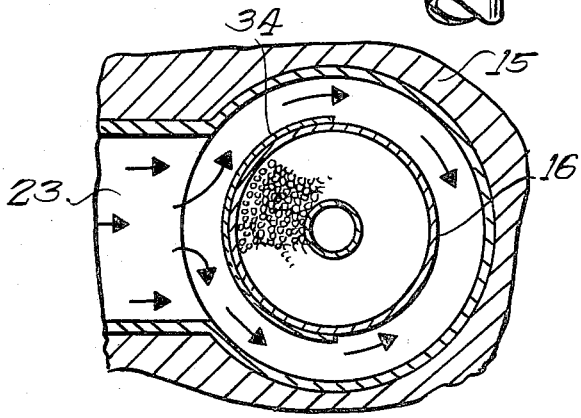
FIG. 9 is a horizontal cross-sectional view taken generally along line 9—9 of FIG. 1.

An annular ring of a plurality of triangular holes 17 is provided in the shroud 16 above the upper tube sheet 30 to permit entry of the reactor coolant into the lower portion of the shroud. The holes 17 may also be of other shapes e.g. round. By forcing the gas to flow downward prior to entering the shroud 16, natural convection is suppressed during non-operating standby conditions of the heat exchange apparatus. This greatly reduces the reactor parasitic heat loss during normal operation of the reactor. An arcuate heat shield 34 is supported on the shroud in spaced relation thereto and opposite the coolant inlet 23 to protect the shroud from heat transmitted through the coolant inlet 23. The coolant gas is caused to circulate through the heat exchanger by the circulator 27, which may be a conventional type. The circulator 27 is supported within the hole 14 by a closure 33 for the upper end of the hole 14. As shown in FIGS. 1 and 9 the circulator causes the gas coolant to be drawn from the reactor through the inlet duct 23, downwardly and then through the holes in the lower end of the shroud 16. The gas then passes up through the shroud 16, through the circulator 27 and out through the exit duct 25.

Figure 10:
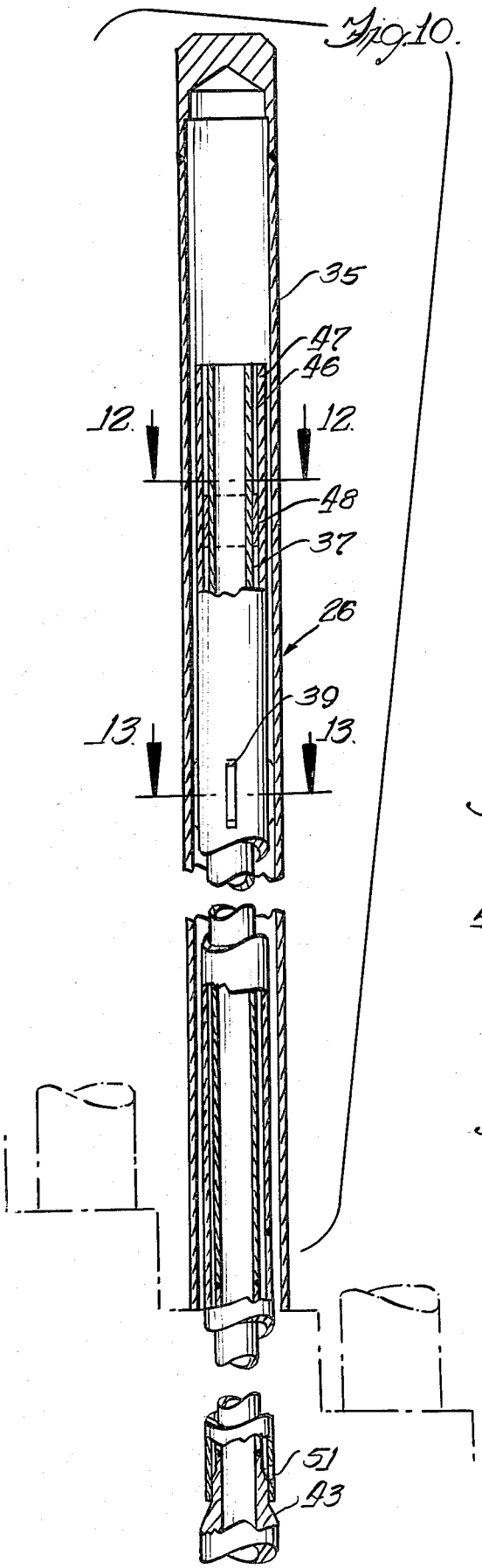
FIG. 10 is an enlarged vertical cross sectional view of one of the bayonet tube assemblies.

Disposed within the shroud 16 are a plurality of spaced apart, vertically extending, bayonet tube assemblies 26. The bayonet tube assemblies 26 extend from approximately the lower end of the shroud 16 to the upper end of the shroud 16. As shown in FIGS. 3, 4 and 10, each bayonet tube assembly 26 includes an outer tube 35 that is closed at its upper end and is supported in its vertical position by attaching its lower end to the upper tube sheet 30, as by welding. In this connection, the upper tube sheet 30 is provided with a vertically extending passageway 36 for each of the bayonet tube assemblies 26 and the outer tube is welded to the upper surface of the upper tube sheet 30 adjacent the passageway 36. The upper surface of the upper tube sheet 30 is stepped to permit easy attachment thereto of the outer tube 35.

Figure 6:
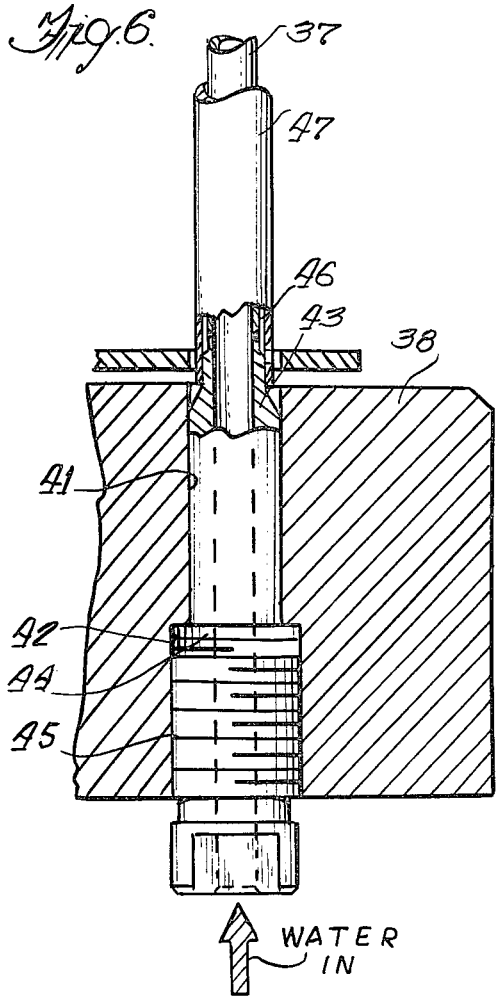
FIG. 6 is an enlarged vertical cross-sectional view of the lower end of one of the bayonet tube assemblies taken generally along line 6—6 of FIG. 5.
Figure 5:
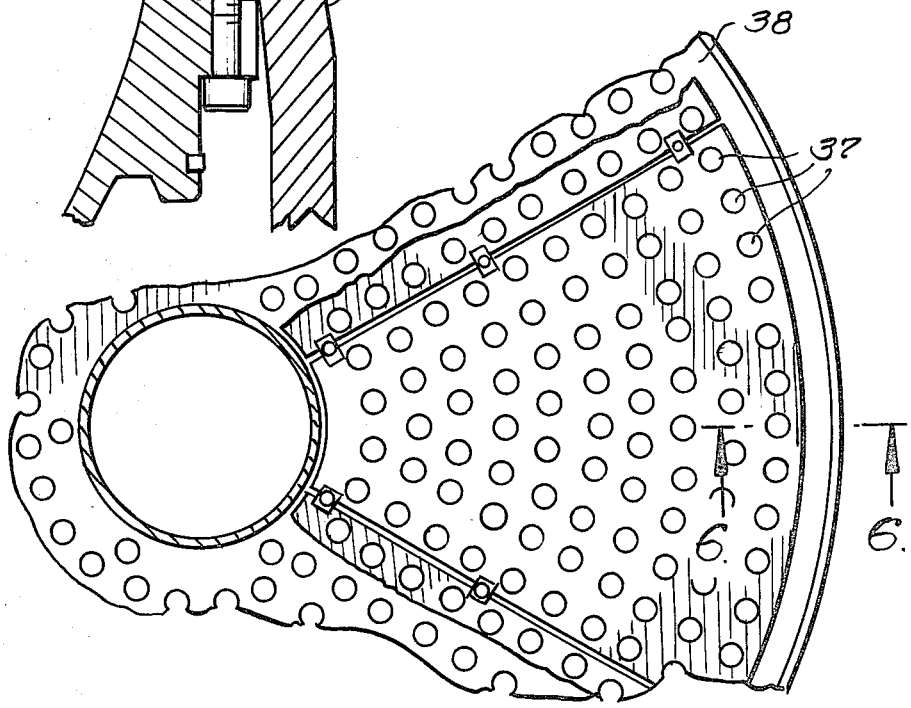
FIG. 5 is an enlarged horizontal cross-sectional view of a portion of the secondary tube sheet taken generally along line 5—5 of FIG. 2 with the bayonet tube assemblies removed.
Figure 7:
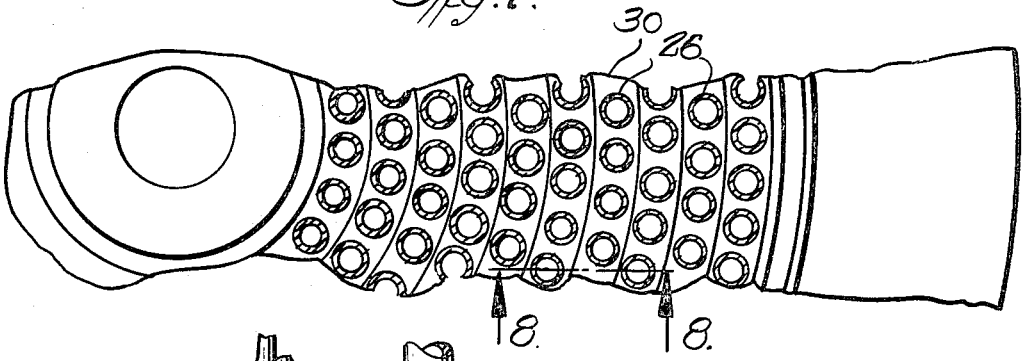
FIG. 7 is an enlarged plan view of a portion of the spherical tube sheet, taken generally along line 7—7 of FIG. 2.
Figure 8:
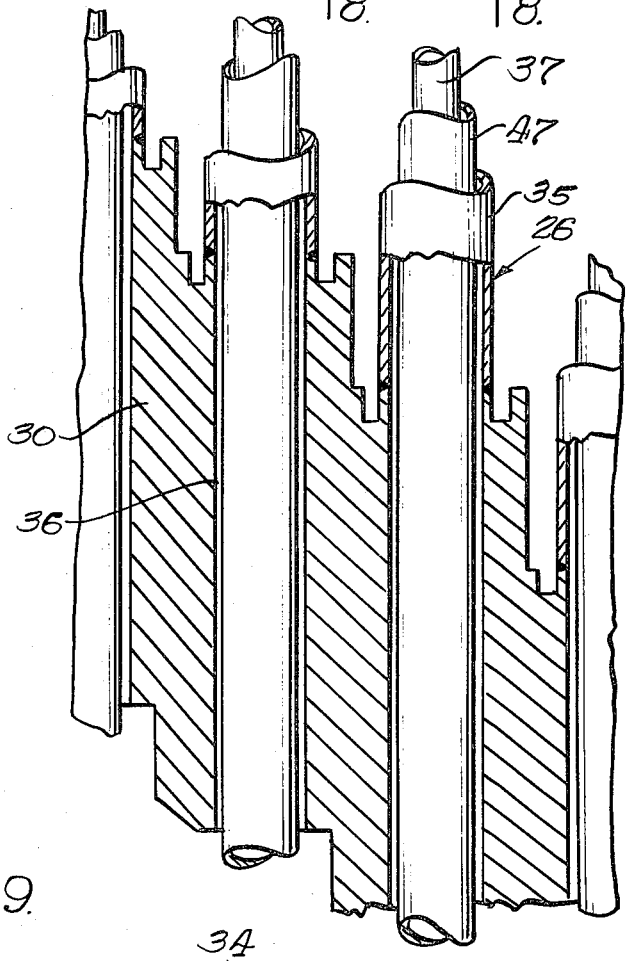
FIG. 8 is an enlarged vertical cross-sectional view of the spherical tube sheet taken generally along line 8—8 of FIG. 7.
Figure 12:
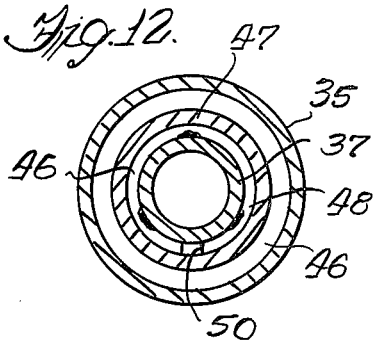
FIG. 12 is an enlarged horizontal cross-sectional view taken generally along line 12—12 of FIG. 10.
Figure 13:
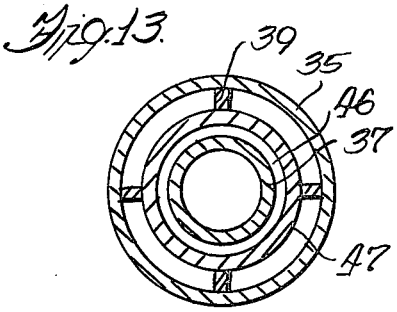
FIG. 13 is an enlarged horizontal cross-sectional view taken generally along line 13—13 of FIG. 10.

As shown in FIGS. 10, 12 and 13 each bayonet tube assembly 26 includes an inner tube 37 that is maintained in spaced relation to the outer tube 35 by a set of four spacers 39. More or less than four spacers may be provided. The inner tube 37 of the bayonet tube assembly 26 extends upward approximately to the upper end of the outer tube 35 and is supported at its lower end by a lower tube sheet 38 that is a flat circular plate releasably attached to the upper tube sheet by studs 40 (FIG. 3). The circular plate 38 may also be contoured. Preferably, the connection between the inner tube 37 and the lower tube sheet 38 is made so that the individual inner tubes 37 may be easily removed from the heat exchanger to permit tube replacement and/or inspection of the upper or lower weld on the outer tube 35 and the outer tube itself during shutdown. More particularly, as shown in FIGS. 3, 4 and 6, the lower tube sheet 38 is provided with a passageway 41 for each inner tube 37, the lower portion of each passageway 41 being enlarged to provide a shoulder 42. The lower end of the inner tube 37 is provided with a tubular fitting 43 having a flange 44 which is held in position against the shoulder 42 by a threaded tubular extension 45 of the inner tube 36.

As shown particularly in FIG. 12, the coolant in the inner tube 37 is insulated from the coolant flowing in the annular space between the inner and outer tubes by a coolant filled annular channel 46 formed by a tube 47 disposed concentrically about the inner tube 37. The concentric tube 47 is maintained in spaced relation to the inner tube 37 by a plurality of vertically spaced rings 48 each of which is provided with a slot 50 (see FIG. 12). The flow of coolant through the channel 46 is thereby restricted to enhance its insulating effect. The coolant exits from the channel 46 through four holes 51 positioned near the lower end of the inner tube 37 but above the lower tube sheet 38.

The inner tube 37 can also be constructed without the insulating tube 47. However, with this construction, due to regenerative heat losses, the entire heat exchanger tube assembly is made longer to make up for this "internal" heat loss.

Figure 11:
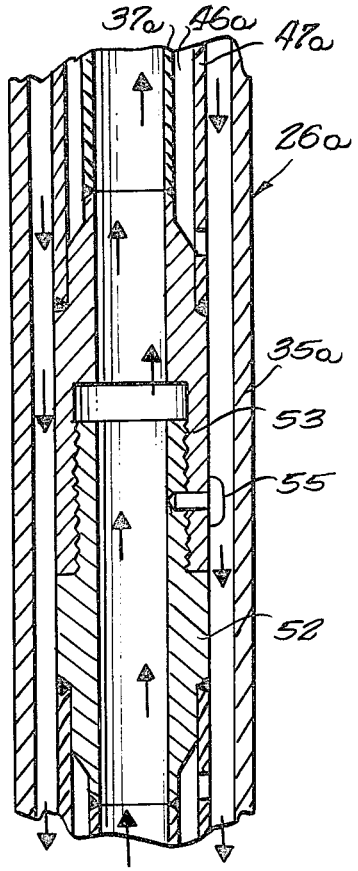
FIG. 11 is an enlarged vertical cross-sectional view of another embodiment of a portion of the bayonet tube assembly shown in FIG. 9.

An alternate construction of the inner tube 37 of the bayonet tube assembly 26 is shown in FIG. 11, wherein similar parts are indicated with the same reference numeral and the suffix "a". In this alternate construction, the inner tube **37*a* is constructed in two parts which are joined together by a threaded fitting 52. In this connection, the threaded male fitting 52 is attached to the upper end of the lower portion of the tube 37*a* and the lower end of the upper portion of the inner tube 37*a* is provided with a threaded female fitting 53. The fittings are threaded together and are locked in position by a pin 55**. Thus, the inner tube assembly may be removed in two pieces thereby reducing the amount of pull space required below the heat exchanger.

Figure 2:
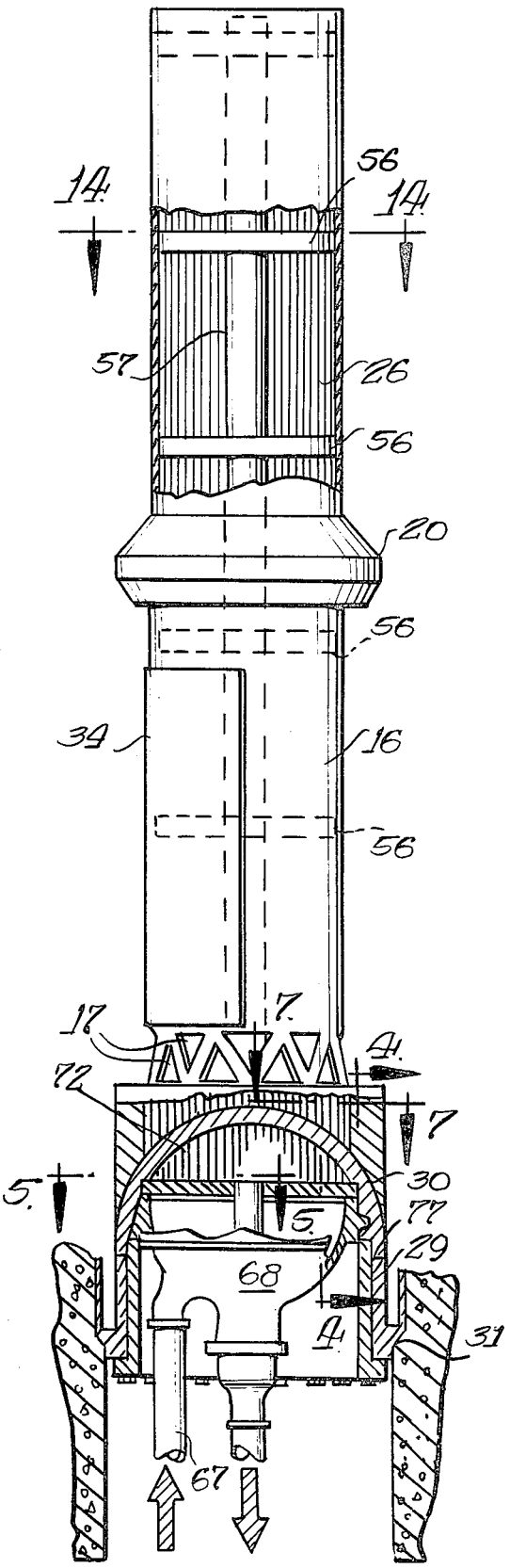
FIG. 2 is an enlarged elevational view, with portions broken away, of the heat exchange apparatus shown in FIG. 1.
Figure 14:
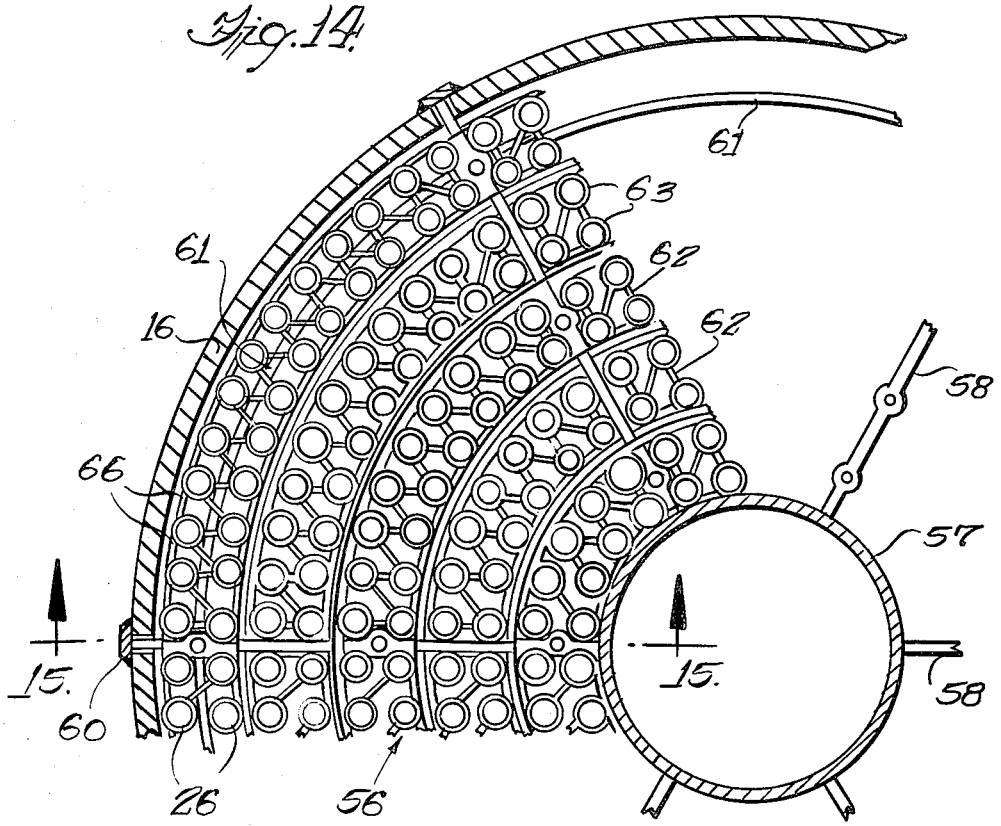
FIG. 14 is an enlarged horizontal cross-sectional view taken generally along line 14—14 of FIG 2.
Figure 15:
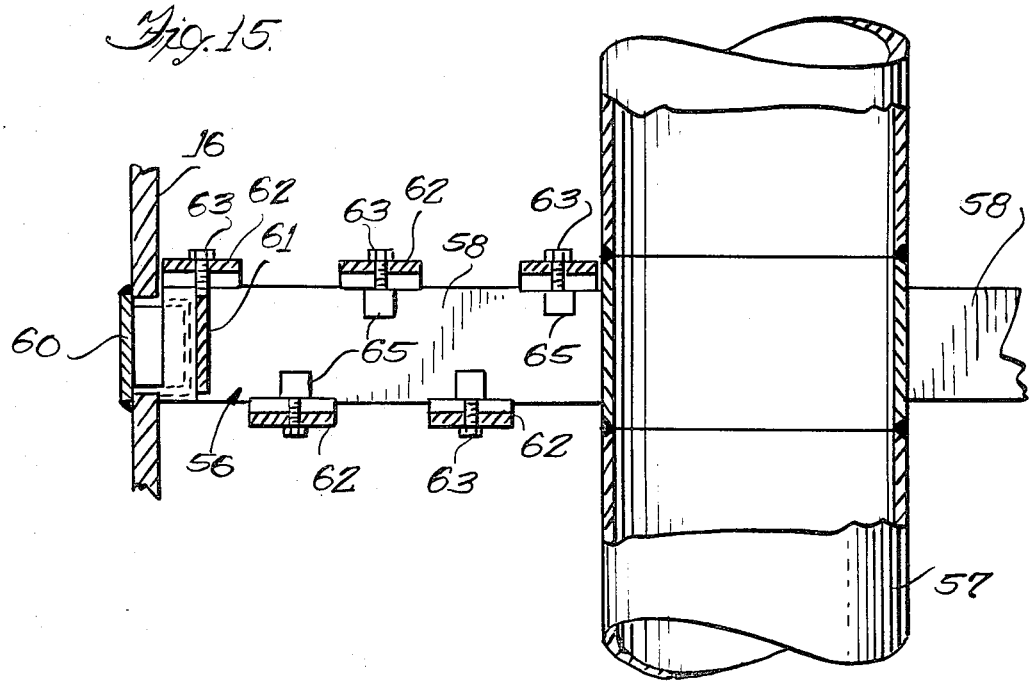
FIG. 15 is a vertical cross-sectional view taken along line 15—15 of FIG. 14.

As shown in FIG. 2, the bayonet tubes 26 are supported laterally by five vertically spaced apart, tube support grids 56. In certain embodiments, more or less than five grids may be used. As shown particularly in FIGS. 14 and 15, the tube support grids 56 are attached to a vertically extending pipe 57 which extends through the center of the shroud 16. The pipe 57 is supported by and attached to the upper tube sheet 30. Each of the tube grid supports 56 includes a plurality of generally rectangular arms 58 extending radially from the center pipe 57 to the shroud 16. The outer end of each arm 58 is notched for receiving the leg of a T-shaped fitting 60 which is attached to the shroud 16 and projects inwardly therefrom. This permits radial and vertical expansion of the shroud 16 with respect to the grid support 56 to thereby minimize thermal expansion stresses. The outer ends of the arms 58 are joined together by arcuate segments 61 of a stabilizing ring. The bayonet tubes 26 are spaced by a plurality of radially spaced, concentric grids 62 alternate ones of which grids are attached to the top and bottom of the arms 58. The grids 62 are segmented and the ends of the segments are suitably notched to provide an overlap where they are joined to the arms 58 as by bolts 63 threaded into respective boses 65 on the arms 58. Each of the grids includes a plurality of interconnected rings 66 are each of which receives a bayonet tube 26.

Secondary coolant, such as water, is fed to the heat exchanger, as shown in FIGS. 1 to 3, by a vertically extending pipe 67 at the lower end of the heat exchanger which is coupled to an inverted, generally hemispherical shaped dome 68. The dome is releasably attached to the upper tube sheet 30 by bolts 70. The secondary coolant fluid from a source (not shown) of coolant enters the chamber 71 defined by the hemispherical dome 68 and the lower tube sheet 38 and flows up through the inner tubes 37 of the bayonet tube assemblies 26 and then downwardly in the annular spaces 46 defined by the inner tubes 47 and the outer tubes 35 of the bayonet tube assemblies 26. At the lower ends of the bayonet tube assemblies 26, the secondary coolant fluid enters an outlet plenum chamber 72 defined by the upper tube sheet 30 and lower tube sheet 38, exits through a vertically extending pipe 73 extending through the inlet plenum 71 and passes to a sink (not shown) for the coolant. The pipe 73 is attached to the dome 68 and a slip joint 75 is provided between the upper end of the pipe 73 and the lower tube sheet 38 so that the dome 68 may be lowered to permit inspection of the bayonet tubes 26.

For inspection of the heat exchanger during plant shutdown, the secondary coolant is gravity drained from the heat exchanger and the dome 68 is lowered. To lower the dome 68, a primary coolant flow restriction skirt 76 which is removably attached to and abuts the inside surface of the annular support 29, is removed. The pipes are disconnected from the dome 68 and then the screws 70 are removed. The dome 68 may then be lowered exposing the lower ends of the bayonet tubes. Individual inner tubes 37 may then be removed by unscrewing the fitting 45.

Alternatively, all of the inner tubes may be removed at one time to enable inspection of the outer tubes 35 by unscrewing the nuts on the lower ends of the studs 40 and lowering the lower tube sheet 38.

During plant shutdown the weld 77 between the upper tube sheet 30 and the annular support 29 may be readily inspected.

In operation, high temperature reactor coolant enters the heat exchanger via the heat entry duct 23 from the core plenum of the reactor. The reactor gas then flows down the outside of the shroud 16 and enters the shroud 16 within the heat transfer bundle area or wherein the bayonet tube assemblies 26 are contained. The down flow prior to entering the heat exchanger may be referred to as a hot trap in that natural convection is suppressed during non-operating standby conditions to thereby reduce the reactor parasitic heat loss. During normal conditions, the heat transfer is effected by having the reactor gas flow over vertical bayonet tubes 26 which contain a circulating heat transfer fluid at a lower temperature. The heat transfer is accomplished by forced convection from the reactor coolant to a secondary coolant medium. The secondary coolant flow in the bayonet tubes 26 takes place by having the incoming flow go up and return via the annulus. The cooled reactor gas exits from the heat exchanger after flowing vertically along the tube bank. The flow of reactor coolant is maintained by the gas circulator.

Various changes and modifications may be made in the above-described heat exchanger without deviating from the spirit or scope of the present invention. Various features of the invention are set forth in the accompanying claims.

What is claimed is:

1. A heat exchange apparatus for transferring heat from a reactor gas coolant to a secondary fluid medium, comprising: an elongated vertically extending housing; an elongated vertical extending tubular shroud supported within said housing in spaced relation thereto, said shroud having a gas entry substantially around the periphery at its lower end and a gas exit at its upper end; means dividing the annular space between said shroud and said housing into an upper and a lower region; an inlet for reactor coolant communicating with said lower region and being spaced above said gas entry to said shroud to thereby suppress natural convection during non-operating standby conditions of said apparatus; an outlet for reactor coolant communicating with said upper region; a plurality of vertically extending, spaced apart bayonet tube assemblies supported within said shroud; means for passing said secondary fluid medium through said tube assemblies; and means for causing reactor coolant to flow in through said inlet, upwardly through said shroud and out through said outlet during emergency conditions of said reactor.

2. Apparatus in accordance with claim 1 wherein the bayonet tube assemblies are vertically supported, by a pair of vertically spaced apart tube sheets, both of said tube sheets being disposed below the gas entry into said shroud, the upper one of said tube sheets being an upwardly facing hemispherical plate connected in gas tight relationship with said housing and having a plurality of upper passageways extending therethrough and disposed respectively below said tube assembies, the outer tube of each bayonet tube assembly being closed at its upper end and having its lower end secured to the upper tube sheet in gas tight relationship with respect to the associated upper passageway, the lower one of said tube sheets being a generally horizontal plate connected in fluid tight relationship with respect to said upper tube sheet so as to provide an upper plenum between said tube sheets, said lower tube sheet having a plurality of lower passageways extending therethrough and disposed respectively below each tube assembly, each inner tube extending through and being spaced from the associated upper passageway and having its lower end secured to the lower tube sheet in fluid tight relationship with the associated lower passageway, means for forming a lower plenum below said lower tube sheet, secondary fluid inlet means being connected to said lower plenum, and secondary fluid outlet means being connected to the upper plenum.

3. Apparatus in accordance with claim 2 wherein the secondary fluid inlet means is a pipe connected to the lower plenum and the secondary fluid outlet means is a vertical pipe which extends through the lower plenum and is connected in fluid communication with an opening in the lower tube sheet.

4. Apparatus in accordance with claim 1 wherein a vertically extending support column extends centrally through said shroud and is supported at its lower end, and a plurality of tube support grid assemblies are vertically spaced along said column for aligning the bayonet tubes for effective heat transfer and for providing a load path for lateral forces, each of said tube support grid assemblies including a plurality of arms attached by one end to said column and extending beyond said tube assemblies, a stabilizing ring encompassing said tube assemblies and being attached to the radial arms, and a plurality to tube grids disposed between and supported by adjacent radial arms, each of said grids including a plurality of spaced apart holes through which the respective tubes pass.

5. Apparatus in accordance with claim 4 wherein the radial arms extend beyond said stabilizing ring, and a generally T-shaped fitting is attached to said shroud opposite the respective ends of the radial arms and with its leg portion extending inwardly of said shroud and means for providing a sliding joint between said leg portion and the outer end of the associated arms whereby the shroud is free to move radially and vertically independent of the tube support assemblies so as to minimize thermal expansion stresses.

6. Apparatus in accordance with claim 2 wherein a vertically extending support column extends centrally through said shroud and is supported at its lower end, and a plurality of tube support grid assemblies are vertically spaced along said column for aligning the bayonet tubes for effective heat transfer and for providing a load path for lateral forces, each of said tube support grid assemblies including a plurality of arms attached by one end to said column and extending beyond said tube assemblies, a stabilizing ring encompassing said tube assemblies and being attached to the radial arms, and a plurality of tube grids disposed between and supported by adjacent radial arms, each of said grids including a plurality of spaced apart holes through which the respective tubes pass.

7. Apparatus in accordance with claim 6 wherein the radial arms extend beyond said stabilizing ring, and a generally T-shaped fitting is attached to said shroud opposite the respective ends of the radial arms and with its leg portion extending inwardly of said shroud and means for providing a sliding joint between said leg portion and the outer end of the associated arm whereby the shroud is free to move radially and vertically independent of the tube support assemblies so as to minimize thermal expansion stresses.

* * * * *